United States Patent [19]

Mon

[11] Patent Number: 5,025,835

[45] Date of Patent: Jun. 25, 1991

[54] LAMINAR FLOW ACOUSTIC SENSOR-AMPLIFIER

[75] Inventor: George Mon, Potomac, Md.

[73] Assignee: The United States of America as represented by the Secretary of the Army, Washington, D.C.

[21] Appl. No.: 541,863

[22] Filed: Jun. 13, 1990

[51] Int. Cl.[5] ..... F15C 1/06

[52] U.S. Cl. ..... 137/833; 137/840

[58] Field of Search ..... 137/833, 840

[56] References Cited

U.S. PATENT DOCUMENTS

| | | | |
|---|---|---|---|
| 4,523,611 | 6/1985 | Przewiecki | 137/833 |
| 4,534,383 | 8/1985 | Phillipi et al. | 137/833 |
| 4,716,935 | 1/1988 | Srour et al. | 137/833 |
| 4,716,936 | 1/1988 | Mon et al. | 137/833 |
| 4,844,128 | 7/1989 | Hockaday | 137/833 |

*Primary Examiner*—A. Michael Chambers

*Attorney, Agent, or Firm*—Saul Elbaum; Paul Clohan

[57] ABSTRACT

A fluidic amplification device having an input, a fluid supply, a fluid supply nozzle for creating a laminar jet of fluid, an output chamber for receiving the laminar jet, control nozzles to control fluid flow through the amplification device from the fluid supply nozzle to the output chamber, wherein the control nozzle acts directly on the fluid to proportionally control the fluid output, vents disposed between the control nozzle and the output chamber, a DC flow output communicating with the output chamber, and pressure signal output ports communicating with the output chamber. By providing outputs for both DC flow and the pressure signal, the DC flow in the pressure signal output channels of the device is reduced and the problems of interstage flow noise, null off-set, parasitic capacitance and inductance in the input and output channels is also reduced.

10 Claims, 6 Drawing Sheets

LAMINAR FLOW ACOUSTIC SENSOR-AMPLIFIER

RIGHTS OF THE GOVERNMENT

The invention described herein may be manufactured, used and licensed by or for the U.S. Government for Governmental Purposes without payment to me of any royalty thereon.

BACKGROUND OF THE INVENTION

The present invention relates to fluid elements and, more particularly, is directed towards a fluidic element which is an improvement upon the Laminar Proportional Amplifier.

The technology known as fluidics provides sensing, computing, and controlling functions with fluid power through the interaction of fluid (liquid or gas) streams. Consequently, fluidics can perform these functions without mechanical moving parts. The inherent advantages of fluidics are, therefore, simplicity and reliability, since there are no moving parts.

Since 1970, a number of important applications of fluidics have been realized. The areas of use include the aerospace industry, medicine, personal-use items, and factory automation. Fluidics for military systems has also progressed to the point where several systems are now in use. In most cases, the reason for selecting fluidics has been a combination of low cost, high reliability, inherent safety, and the ability to operate in severe environments Almost all early (first generation) fluidic devices were operated in the turbulent-flow regime. Since the mid-1970's, the emphasis has shifted to the use of laminar-flow (second generation) fluidic components. Turbulent flow is characterized by a "noisy" jet; in contrast, laminar flow is characterized by a "quiet" well-defined jet. Laminar-flow fluidic devices are used primarily in signal applications where the ability to detect and process extremely small pressure signals is essential.

Most fluidic amplifiers have at least four basic functional parts. These include (1) a supply port, (2) one or more control ports, (3) one or more output ports, and (4) an interaction region. These sections may be compared, respectively, to the cathode, control grid, plate, and interelectrode region of a vacuum tube. Many fluidic amplifiers also contain vents to isolate the effects of output loading from the control flow characteristics.

The supply jet in the fluidic amplifier passes into the interaction region where it is directed toward the output port(s) or receiver(s). Control flow injected into the interaction region determines the direction and distribution of the supply flow, which in turn affects the flow reaching the receiver(s). The amount of pressure or flow recovery available in a receiver is determined by the internal shape of the device. Useful amplification occurs inasmuch as change in output energies can be achieved with small changes in control energies.

Laminar proportional amplifiers (LPA's) and sensors are active (flow consuming) devices that form the building blocks of fluidic control systems. A typical application requires several of these active devices interconnected to perform a specific control function. Generally they are packaged to provide a means to interconnect these devices, distribute the supply and vent flow, and accommodate additional components such as flow restrictors and volumes required to accomplish various control functions. The most convenient configuration is to use a planar element format which has two flat sides.

Staging is the process of connecting two or more amplifiers in series to obtain an increase in gain. An LPA has a pressure gain, i.e., a small change in pressure at the inputs produces a larger change in pressure at the outputs. The pressure gain is at a maximum when no flow is delivered at the outputs (blocked load). Pressure gain decreases as flow is withdrawn from the amplifier outputs. If the amplifier outputs are wide open, the pressure gain is essentially zero. An LPA also has flow gain; a small change in flow at the inputs produces a larger change in flow at the outputs. Flow gain is maximum when the amplifier outputs are wide open, and is zero when the amplifier is operated block loaded. Since power is defined as the product of pressure and flow, an LPA also has power gain.

Of the three gains described above, staging for pressure gain is the most common requirement. There are several methods of staging LPA's to obtain pressure gain. For example, amplifiers can be self-staged by connecting identical elements all operating at the same supply pressure. This practice is convenient for assembly and manifolding and for maximizing the input/output resistance ratio; however, dynamic range is not optimized. Dynamic range is related to the maximum available output signal which, for LPA's, increases with an increase in supply pressure. If two identical amplifiers operating at the same supply pressure are staged, the first amplifier will saturate the second amplifier before the first amplifier reaches its own saturation level. Thus, the full dynamic range of the first amplifier is not being used. In some applications, the single-stage amplifier dynamic range is high enough so that a self-staged reduction in dynamic range can be tolerated.

Thus it can be seen from the above discussion that it is well known in the art that LPA's can be staged to form gainblocks with high pressure gain and dynamic range. In a conventionally staged gainblock, the output flows from the previous stage are directed to flow completely into the input ports of the next stage. As a result, flow noise is generated within the interconnection region by the interaction of the fluid molecules with the wall of the interconnection passage and this flow noise is amplified by the next stage. This amplified flow noise can significantly reduce the signal-to-noise ratio in the output signal.

When conventionally staged gainblocks are used to sense very low pressure signals, the interstage flow noise generally overwhelms the input signals. As a result, it is impossible to detect any output signal at the output ports without signal processing and filtering.

One of the major problems facing a designer of fluidic systems concerns the ever present null off-set due to supply pressure or temperature variations. This problem is present, for example, not only in LPA's but in laminar jet rate sensors. Each of these components, as well as other components, utilize a plurality of extremely thin metal laminate plates which have the appropriate fluid passages formed therein.

The problem of null off-set is caused by geometric imperfections in the plates which inherently result from the manufacturing process. Typical prior art manufacturing processes include machining, metal etching of the individual laminate elements, and fine blanking. For the first two techniques, it is almost impossible to produce a symmetrical fluidic element, such as a LPA. Furthermore, the machining and metal etching manufacturing techniques produce geometric imperfections in these elements which are random in nature. Therefore, it is extremely difficult to compensate for null off-set with randomly imperfect elements. Fine blanking has produced laminates have produced a predictable null off-set which can be compensated. However, null off-set is still present due to the interstage flow noise.

It can be seen, therefore, that there is a great need for an improved LPA so that interstage flow noise and null off-set is reduced or eliminated.

OBJECTS AND SUMMARY OF THE INVENTION

It is therefore the primary object of the present invention to minimize the DC flow in the pressure signal output channel of the LPA thereby reducing the problem of interstage flow noise and null off-set.

Another object of the present invention is to provide an acoustic sensor-amplifier with little or no parasitic capacitance and inductance in the input and output channels.

A further object of the present invention is to simplify the basic configuration of the acoustic sensor-amplifier so that the device can be fabricated by micro-machining techniques.

A still further object of the present invention is to provide a pressure signal sensor-amplifier with extremely small flow noise thus improving the dynamic range in comparison to conventional LPA's.

The present invention provides a better Laminar Flow Acoustic Sensor-Amplifier. This new acoustic sensor-amplifier design has essentially no flow noise or null off-set problems which are problems with conventional Laminar Proportional Amplifiers. This new design has also minimized the parasitic capacitance and inductance in both the input and output channels. Consequently, the frequency response of this new sensor is dependent only on the dynamics of the supply jet. By eliminating most of the inter-stage DC flow, one can easily stage this new acoustic amplifier to form gain-blocks with very high pressure gain.

DETAILED DESCRIPTION OF THE PREFERRED EMBODIMENTS

Figure 1:
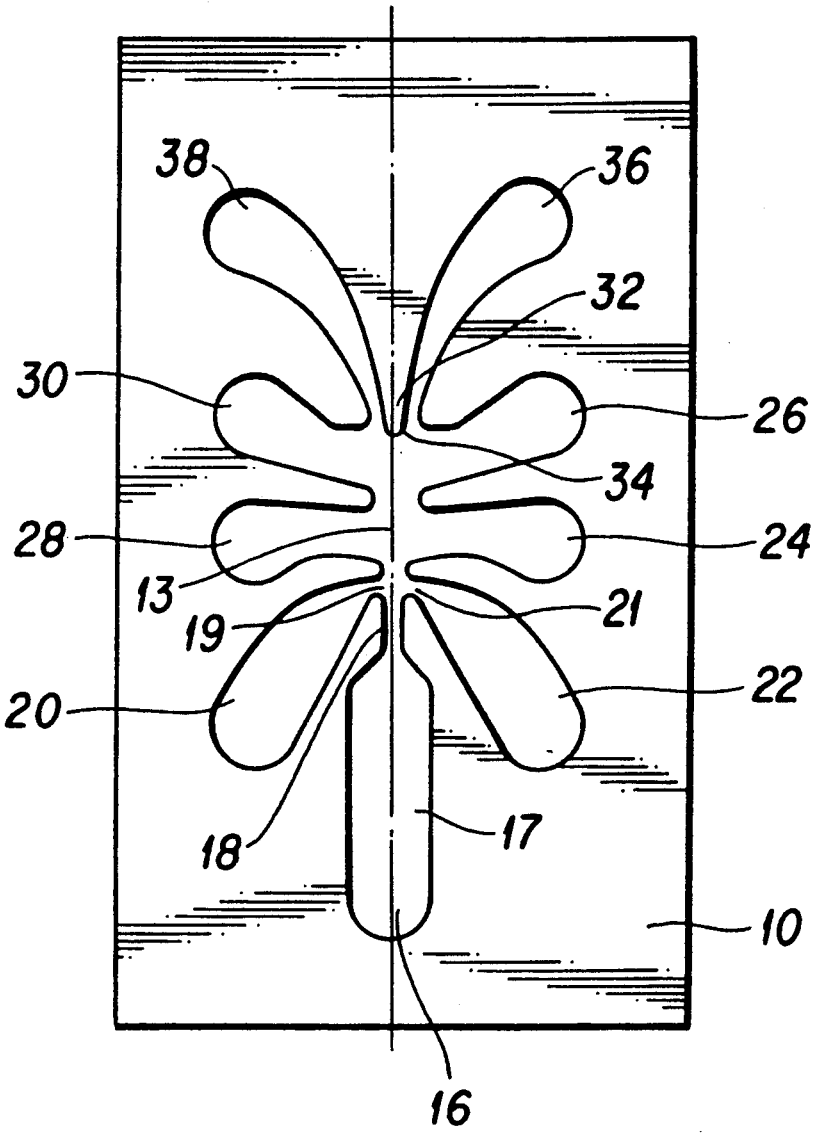
FIG. 1 discloses a plan view of a conventional Laminar Proportional Amplifier.

In FIG. 1 can be seen a conventional Laminar Proportional Amplifier well known in the prior art. In FIG. 1, amplifier 10 is sandwiched between backing plates (not shown) wherein the voids in amplifier plate 10 and the backing plates combine to create a void in which fluid can flow. This technique is also used in the present invention, although it is not shown as those skilled in the art will recognize how this is accomplished without the aid of a drawing. In the amplifier plate 10, fluid input 16 is shown having an elongated fluid path 17 and a supply nozzle 18. Incoming fluid passes through supply nozzle 18 through the amplifier body and out fluid output ports 36 and 38. The fluid flow that comes out supply nozzle 18 is controlled by fluid entering through control ports 20 and 2 through control nozzles 19 and 21 respectively. These control nozzles 19 and 21 direct the fluid flow out of the supply nozzle 18 toward either of the fluid output ports 36 or 38 and are provided with vents 24, 26, 28, and 30 to allow the fluid supply to exit in the event that there is a clog in the fluid output ports 36 or 38 or to allow adjustment for ambient pressure changes.

The fluid proceeds down fluid passage 13 and encounters a conventional flow splitter 32 which divides the fluid flow into one of two paths. The flow splitter leading edge 34 splits the flow and directs the fluid into fluid output port 36 or fluid output port 38 when the fluid stream is directed by pressures from the control nozzles 19 and 21. The direction of fluid flow is directed by control fluid coming out of the control nozzles 19 and 21 which can apply pressure to either side of the fluid flow to direct it towards the proper outputs 36 or 38. In the conventional embodiment shown in FIG. 1, flow splitter 32 has a fixed flow splitter leading edge 34 directly downstream of the outlet nozzle 18 which directs the flow onto either side of leading edge 34 to the fluid outputs 36 or 38 respectively. The control ports 20 and 22 can supply fluid which goes out of nozzles 19 and 21 respectively to direct the fluid flow from supply nozzle 18 to either side of the leading edge 34 to the outputs 36 and 38. In this manner, the fluid flow within the amplifier can be directed by the fluid flow in the control ports 20 and 22.

Figure 2:
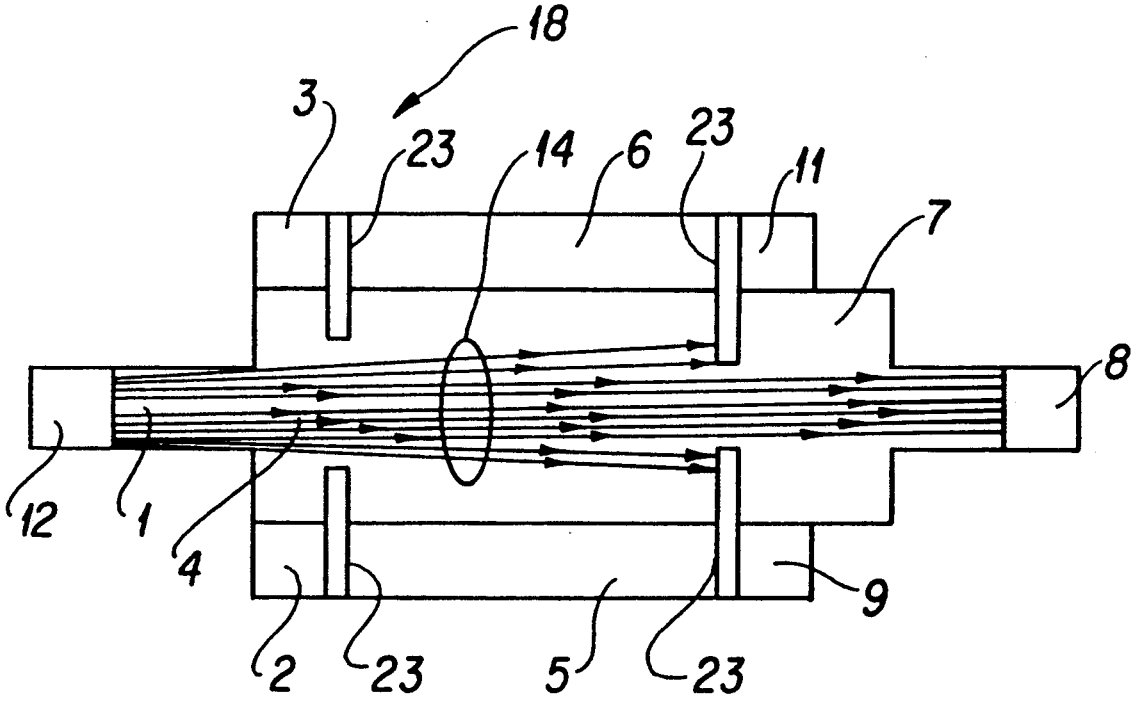
FIG. 2 discloses a plan view of a Laminar Flow Acoustic Sensor-Amplifier according to the present invention with an undeflected supply jet.

FIG. 2 shows a plan view of a Laminar Flow Acoustic Sensor-Amplifier 18 according to the present invention. In a fashion similar to the LPA of FIG. 1 it consists of a supply nozzle 1, two control ports 2 and 3, an interaction region 4, two vents 5 and 6, an output chamber 7, a DC flow output port 8, two pressure signal output ports 9 and 11, and four partitions 23 which provide separation between the vents and the ports to either side. When a supply fluid is supplied to the supply nozzle 1 through supply port 12, a laminar jet 14 is issued from the supple nozzle 1. This laminar jet 14 flows through the interaction region 4, passes through output chamber 7 and then exits through the DC flow output port 8. There will be little or no flow coming out through either pressure signal output port 9 or 11. As in the prior art embodiment of FIG. 1, the laminar flow acoustic sensor-amplifier 18 is sandwiched between backing plates (not shown) wherein the voids in amplifier plate 18 and the backing plates combine to create a void in which fluid can flow. Access must be provided for supply port 12, control ports 2 and 3, vents 5 and 6, pressure signal output ports 9 and 11 and DC flow output port 8. The method of sandwiching laminar flow amplifiers is well known in the art and needs no further discussion here.

Figure 3:
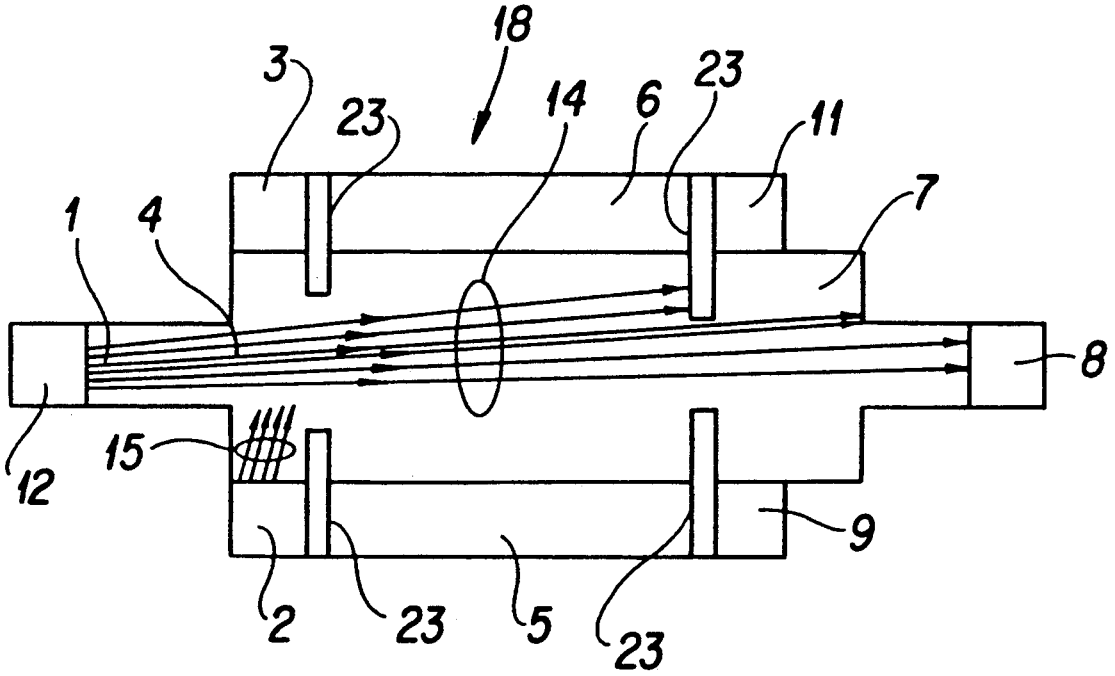
FIG. 3 discloses a plan view of a Laminar Flow Acoustic Sensor-Amplifier according to the present invention with a deflected supply jet.
Figure 4:
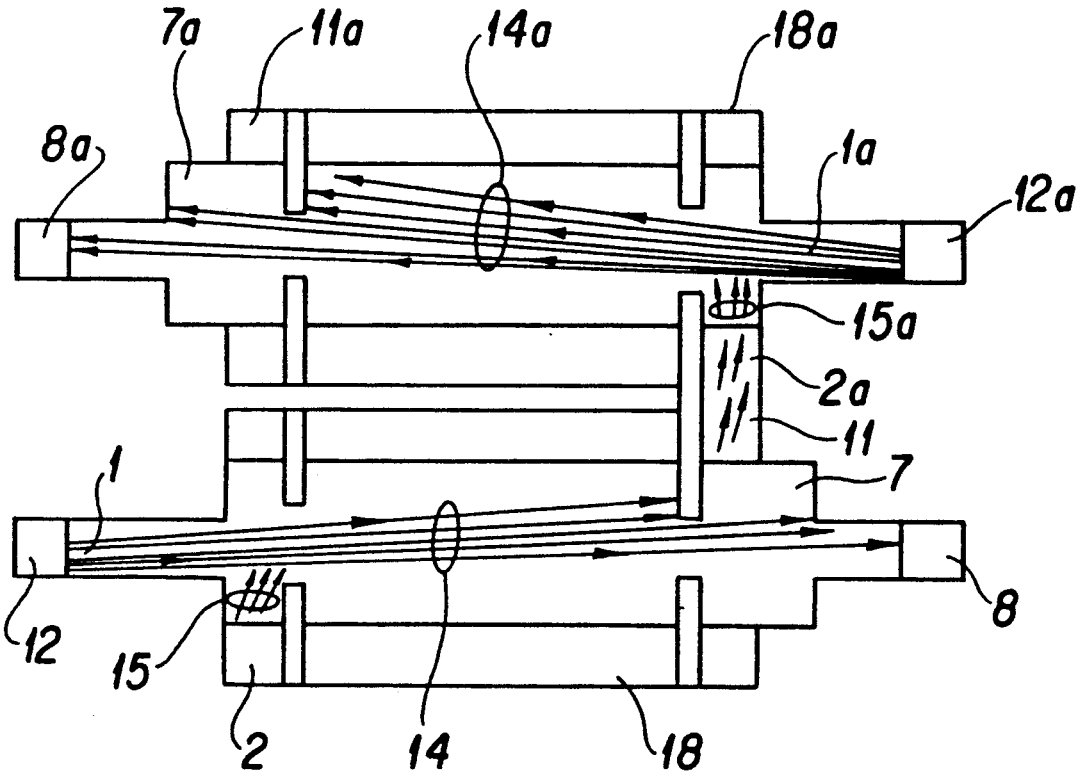
FIG. 4 discloses a plan view of a two-stage Laminar Flow Acoustic Sensor-Amplifier according to the present invention with an input signal applied to one of the input ports.

FIG. 3 shows a schematic of a Laminar Flow Acoustic Sensor-Amplifier according to the present invention with the laminar jet 14 deflected. When an input pressure signal 15 is applied to control port 2, this applied pressure signal deflects the laminar jet 14 upwards as shown. As a result, the deflected laminar jet 14 will create an amplified pressure signal within the output chamber 7. An output pressure signal will then develop at the pressure signal output port 11. Due to the amplification action of the laminar jet 14, the output signal at pressure signal output port 11 will be larger than the input pressure signal 15 at control port 2. Thus we have obtained a pressure gain $G_p$, which is the ratio of the output pressure, $P_o$, to the input pressure $P_i$. In general the differential pressure gain of a laminar flow amplifier is about 8–10. The laminar flow acoustic sensor-amplifier of FIG. 3 can be staged as shown in FIG. 4 to form a gain-block with very high pressure gain. Laminar flow acoustic sensor-amplifier 18 is mated to laminar flow acoustic sensor-amplifier $\mathbf{18}_a$ by connecting the pressure signal output port 11 of laminar flow acoustic sensor-amplifier 18 to the control port $\mathbf{2}_a$ of laminar flow acoustic sensor-amplifier $\mathbf{18}_a$ in a conventional well known manner. Thus the output signal at the pressure signal output port 11 of laminar flow acoustic sensor-amplifier 18 becomes the input signal at control port $\mathbf{2}_a$ of laminar flow acoustic sensor-amplifier $\mathbf{18}_a$. Laminar flow acoustic sensor-amplifier $\mathbf{18}_a$ is identical to laminar flow acoustic sensor-amplifier 18 with identical elements marked with the subscript $_a$. Note that since most of the DC flow has been minimized at the pressure signal output ports, the problem of null off-set and flow noise has been reduced.

Figure 5:
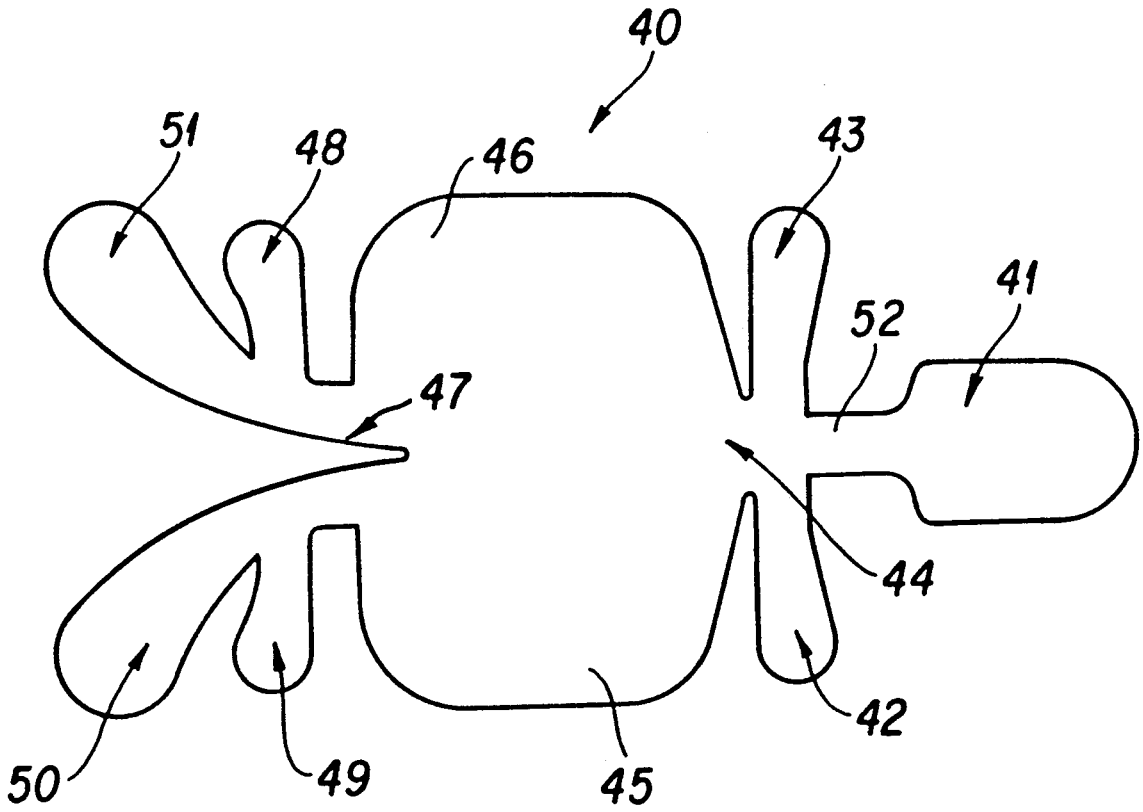
FIG. 5 discloses a plan view of an alternate embodiment of a Laminar Flow Acoustic Sensor-Amplifier according to the present invention .

FIG. 5 shows an alternate embodiment of a Laminar Flow Acoustic Sensor-Amplifier 40 according to the present inventive concept. This acoustic amplifier has a basic design similar to that of the conventional LPA shown in FIG. 1 with the exception of the output channel configuration, having a conventional fluid input 41, supply nozzle 52, two control ports 42 and 43, an interaction region 44, two vents 45 and 46, a flow splitter 47, and two DC flow output ports 50 and 51. In this embodiment of the laminar flow acoustic sensor-amplifier, the pressure signal output ports 48 and 49 are branched out from the output channels as shown allowing most of the DC flow to exhaust through the DC output ports 50 and 51. Note that the pressure signal output ports 48 and 49 are located only one to two supply nozzle 52 widths from the splitter 47. Due to the new strategic location for the pressure signal output ports 48 and 49, the dynamic response of this embodiment of the laminar flow acoustic sensor-amplifier will not be degraded by the parasitic capacitance and inductance of the output channels. Since most of the DC flow has been eliminated at the pressure signal output ports the problems of interstage flow noise and null off-set have been minimized.

Figure 6:
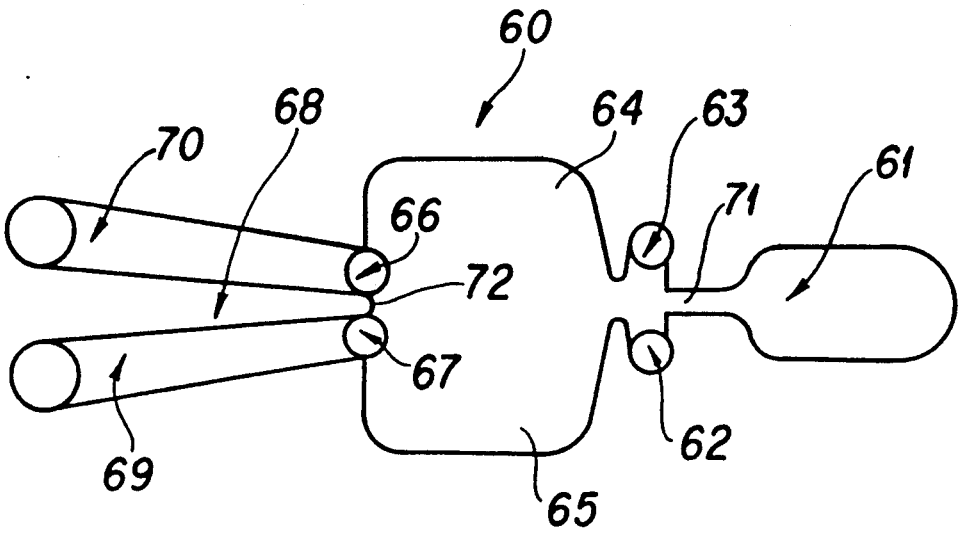
FIG. 6 discloses a plan view of an additional alternate embodiment of a Laminar Flow Acoustic Sensor-Amplifier according to the present invention .
Figure 7:
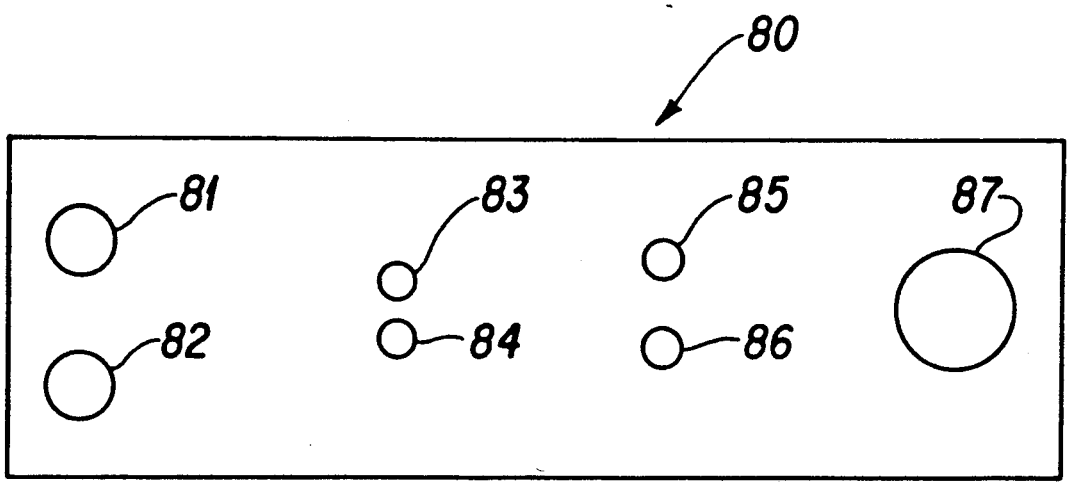
FIG. 7 discloses a cover plate for the additional alternate embodiment of a Laminar Flow Acoustic Sensor-Amplifier shown in FIG. 6.

FIG. 6 shows a second alternate embodiment of a Laminar Flow Acoustic Sensor-Amplifier 60 according to the present inventive concept. This embodiment has a conventional fluid input 61, supply nozzle 71, and two control ports 62 and 63. In this embodiment, the venting area with vents 64 and 65 has been simplified and the length of the input channel has also been greatly reduced in comparison with the more conventional design as shown in FIG. 5. Note that the control ports 62 and 63 are located very close to the supply nozzle 71 exit and the pressure signal output ports 66 and 67 are located just next to the splitter 72. DC flow output ports 69 and 70 are also provided as in the other embodiments. FIG. 7 shows the basic design configuration of the cover plate 80 in which the control ports 85 and 86, and the pressure signal output ports 83 and 84 are located. The fluid input is shown as 87 and the DC flow output ports are 81 and 82. With this new configuration, the parasitic capacitance and inductance in both the input and output channels have been minimized. Thus, the frequency response of this new acoustic amplifier is dependent only on the dynamics of the supply jet. Note that the control ports 85 and 86 and the pressure signal output 83 and 84 ports are nothing but circular holes which are located on the cover plate.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A fluidic amplification device comprising:

input means having a fluid supply means;

a fluid supply nozzle for creating a laminar jet of said fluid;

control nozzle means to control fluid flow through said amplification device wherein said control nozzle means acts directly on said fluid to proportionally control said fluid output;

a pair of fluid output ports separated by a flow splitter means to proportionally divide the fluid flow flowing from said fluid supply nozzle to said pair of fluid output ports;

vent means disposed between said control nozzle means and said flow splitter means;

DC flow output means located within each of said fluid output ports;

a pressure signal output port within each of said fluid output ports.

2. The device of claim 1 wherein said fluid amplification device is located within a top and bottom cover plate.

3. A fluidic amplification device comprising:

input means having a fluid supply means;

a fluid supply nozzle for creating a laminar jet of said fluid;

control nozzle means of substantially circular cross section to control fluid flow through said amplification device wherein said control nozzle means acts directly on said fluid to proportionally control said fluid output;

a pair of fluid output ports separated by a flow splitter means to proportionally divide the fluid flow flowing from said fluid supply nozzle to said pair of fluid output ports;

vent means disposed between said control nozzle means aid said flow splitter means;

DC flow output means of substantially circular cross section located at the end of each of said fluid output ports;

a pressure signal output port of substantially circular cross section on either side of said flow splitter means and located within each of said fluid output ports.

4. The device of claim 3 wherein said fluid amplification device is located within a top and bottom cover plate.

5. A fluidic amplification device comprising:

a laminar proportional amplifier plate having a rectangular cavity thereon;

an inlet situated at one end of said rectangular cavity comprising a fluid supply port and a fluid supply nozzle for creating a laminar jet of said fluid issuing into said rectangular cavity along an axis coaxial with the longitudinal axis of said cavity;

an outlet situated at the opposite end of said cavity from said inlet, said outlet comprising a DC flow output port coaxial with the longitudinal axis of said cavity, and a pair of pressure signal output ports on either side of said longitudinal axis of said cavity;

a pair of control nozzles adjacent to said inlet to control fluid flow through said cavity, wherein said control nozzles act directly on said laminar jet of said fluid to proportionally control said fluid output;

a pair of vents disposed on either side of said cavity between said control nozzles and said pressure signal output ports;

a first pair of partitions between said control nozzles and said vents and a second pair of partitions between said pressure signal output ports and said vents, said partitions extending into but not completely across said cavity.

6. The device of claim 5 wherein said DC flow output port has a square cross-sectional area.

7. The device of claim 5 wherein said pressure signal ports have a square cross-sectional area.

8. The device of claim 5 wherein said control nozzles have a square cross-sectional area.

9. The device of claim 5 wherein said vents have a rectangular cross-sectional area.

10. The device of claim 5 wherein said fluid supply port has a square cross-sectional area.

* * * * *